US007158448B1

(12) United States Patent
Gabathuler et al.

(10) Patent No.: US 7,158,448 B1
(45) Date of Patent: Jan. 2, 2007

(54) TIMEPIECE WITH DATE MECHANISM

(75) Inventors: Jacques Gabathuler, Collonges sous Saleve (FR); Cedric Jacot, La Chaux-de-Fonds (CH); Trung Thanh Nguyen, Grand-Lancy (CH)

(73) Assignee: Breitling AG, Grenchen (CH)

( * ) Notice: Subject to any disclaimer, the term of this patent is extended or adjusted under 35 U.S.C. 154(b) by 0 days.

(21) Appl. No.: 11/484,731

(22) Filed: Jul. 12, 2006

(30) Foreign Application Priority Data

Jul. 20, 2005 (EP) ..... 05405446

(51) Int. Cl.
*G04B 19/20* (2006.01)
*G04B 19/24* (2006.01)

(52) U.S. Cl. ..... 368/37; 368/38

(58) Field of Classification Search ..... 368/28, 368/35–38
See application file for complete search history.

(56) References Cited

U.S. PATENT DOCUMENTS 3,177,646 A * 4/1965 Ernest et al. ..... 369/296
3,449,905 A 6/1969 Besson
3,677,211 A * 7/1972 Miller et al. ..... 72/370.13
4,194,353 A * 3/1980 Thomi et al. ..... 368/38

FOREIGN PATENT DOCUMENTS

CH 460645 A 3/1968
CH 525508 A 3/1972

OTHER PUBLICATIONS

European Search Report dated May 12, 2006 in European application No. 05405446.

* cited by examiner

*Primary Examiner*—Vit W. Miska
(74) *Attorney, Agent, or Firm*—Westerman, Hattori Daniels & Adrian LLP

(57) ABSTRACT

This date mechanism comprises a calendar mobile (1), a driving mobile (3) an instantaneous-jump cam (7), a finger (9*b*) kinematically connected to this cam (7) in order to drive the calendar mobile (1). The driving finger (9*b*) is borne by a release member (9) which is mounted pivotably about two axes (3*a*, 7*a*), one (3*a*) of which is that of the driving mobile (3), this release member (9) having an opening (9*a*) configured to allow an angular displacement about the second of these two axes (7*a*), whereby the driving finger (9*b*) can be released from the toothing (1*a*) of the calendar ring while the calendar is corrected. A return spring (8) tends to rotate the driving finger (9*b*) about the second pivot axis (7*a*) in order to bring it to butt against an edge of the opening (9*b*), a position in which the driving finger is engaged with the toothing of the calendar ring (1).

2 Claims, 5 Drawing Sheets

TIMEPIECE WITH DATE MECHANISM

The present invention relates to a timepiece with date mechanism, comprising a calendar mobile engaging with an angular positioning jumper, a mobile for driving this calendar mobile, a positive connection between this driving mobile and a minute train for rotating said driving mobile at the rate of one turn every twenty-four hours, an instantaneous-jump cam, an elastic energy accumulator engaging with this cam in order to displace it instantaneously once per turn of said driving mobile, a finger kinematically connected to this cam in order to drive the calendar mobile, a kinematic connection between the driving mobile and the cam, with a degree of freedom chosen to allow the elastic energy accumulator to release its energy by imparting upon it a relative movement, to enable the driving finger to displace the calendar mobile instantaneously by one step.

It is known that in timepieces of the abovementioned type, the calendar display mobile is at risk of being driven by more than one step by the instantaneous jump drive mechanism, thus making the display jump by two, or even three dates.

Various solutions have already been proposed to prevent this risk. Amongst these solutions, one consists in locking the driving finger between two teeth after the calendar mobile has been driven by one step. This solution has a danger, however, should one wish to correct the date at this moment. This is impossible, but by forcing, serious damage could be caused to the mechanism.

In order to avoid this risk, solutions have been proposed in which a bolt is elastically engaged in the toothing of the calendar mobile and is disengaged exactly during the instantaneous driving of the calendar mobile. A mechanism of this kind is described in FR 1.609.905. The drawback of this device derives from the fact that, during the instantaneous driving of the calendar mobile, the energy accumulated for this driving must also serve to surmount the elastic force exerted upon the locking member, so that such a solution requires a daily over-consumption of energy.

There are also mechanisms comprising an instantaneous-jump driving finger which is held in the toothing of the calendar mobile after this has jumped, this driving finger being linked to the driving device by elastic means to allow the toothing of the calendar display mobile to move this finger should the date be manually reset.

The drawback of this solution derives from the fact that, in the normal state, this elastic finger is free and is not therefore under tension, so that it is difficult to have a precise rest position due to remanence phenomena. Moreover, the equilibrium between the spring of the instantaneous-jump drive and that of the finger is difficult to achieve, since the finger must be, on the one hand, sufficiently rigid to drive and then lock the disk and, on the other hand, sufficiently flexible to allow the correction.

In CH 525 508, there has further been proposed a driving device for an instantaneous-jump calendar display, which is solely constituted by members borne by the hour wheel and the minute wheel pinion and in which the member borne by the wheel and the minute wheel pinion is firstly displaced about an eccentric pivot relative to the minute wheel, moving it away from its rest position while loading a spring coaxial with the minute wheel. At the end of the loading, this member is released, which allows it to be projected into the toothing of the calendar display disk so as to drive it instantaneously by one step. At the end of this drive, the finger of the driving member is situated outside the toothing of the calendar disk, so that this mechanism contains no means for preventing this disk from jumping by more than one step.

The object of the present invention is to eliminate, at least partially, the abovementioned drawbacks.

To this end, the subject of this invention is a timepiece with calendar mechanism of the abovementioned type, such as defined in claim 1.

The main advantages of the solution forming the subject of the invention are the fact that the position of the finger in the normal state is perfectly defined and that the spring which holds the finger in this normal position is preloaded. Another advantage derives from the fact that the driving device of the instantaneous-jump calendar mobile does not have to surmount the force holding the driving finger in its normal position. The driving finger hence behaves like a rigid finger, except when the calendar mobile is displaced when this finger is engaged in its toothing. Finally, the number of parts involved is reduced to a minimum and this device requires no adjustment during the assembly.

The appended drawings illustrate, diagrammatically and by way of example, an embodiment of the timepiece forming the subject of the present invention.

Figure 1:
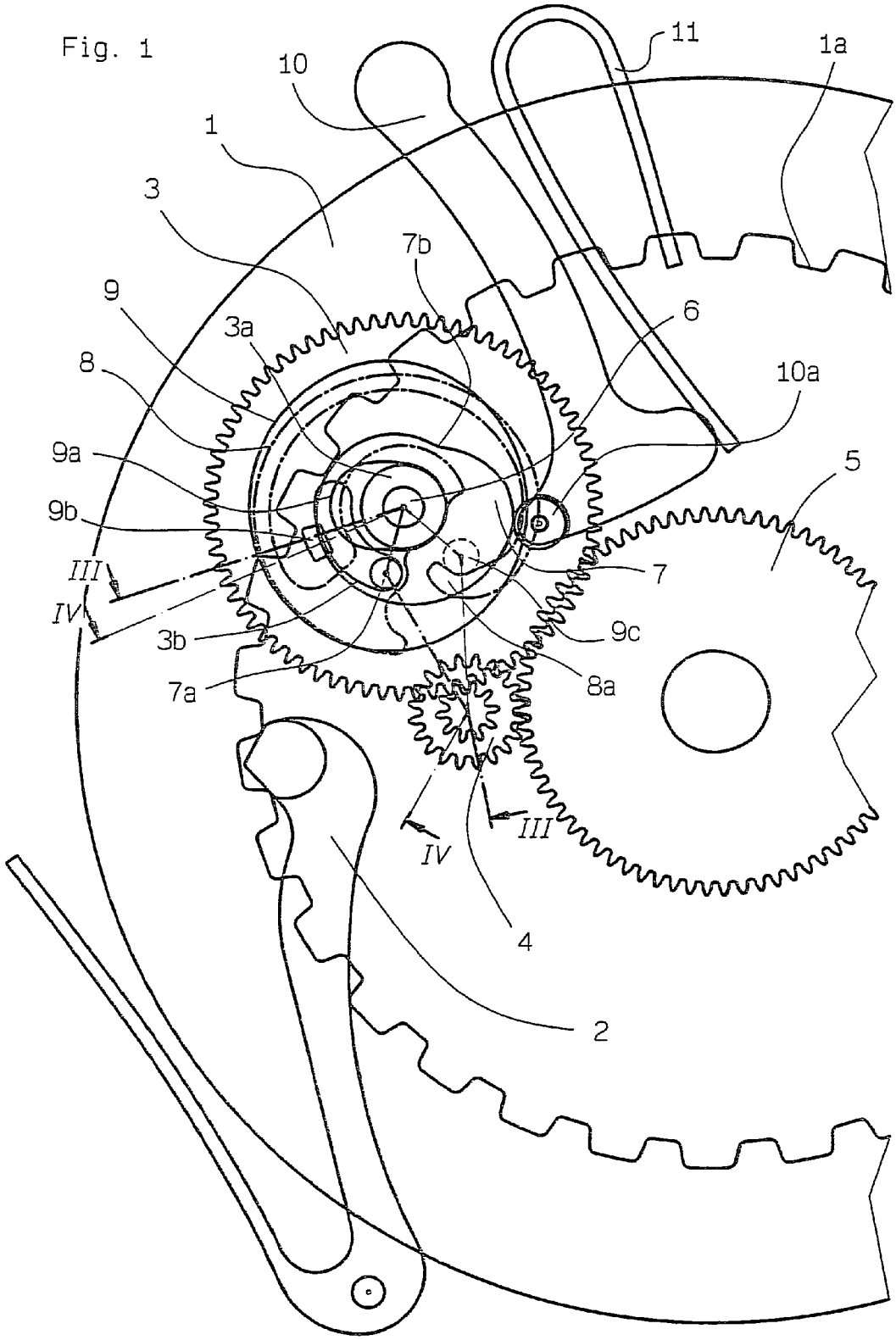
FIG. 1 is a plan view of the date mechanism of this timepiece, showing this mechanism just before the instantaneous jump.

The mechanism illustrated by FIG. 1 comprises a calendar mobile 1 in the form of a ring or a disk bearing the numerals 0 to 31 (not represented) and with an inner toothing 1*a* of thirty-one teeth, engaging with a spring-action positioning jumper 2.

A driving wheel 3 (FIG. 2) of the calendar mobile 1 meshes with a pinion 4*a* of a reducer mobile 4 meshing with the hour wheel 5 or cannon wheel. This hour wheel 5 makes one turn in twelve hours and the gear ratio between this hour wheel 5 and the driving wheel 3 is 2/1, so that the driving wheel 3 makes one turn in twenty-four hours.

Figure 2:
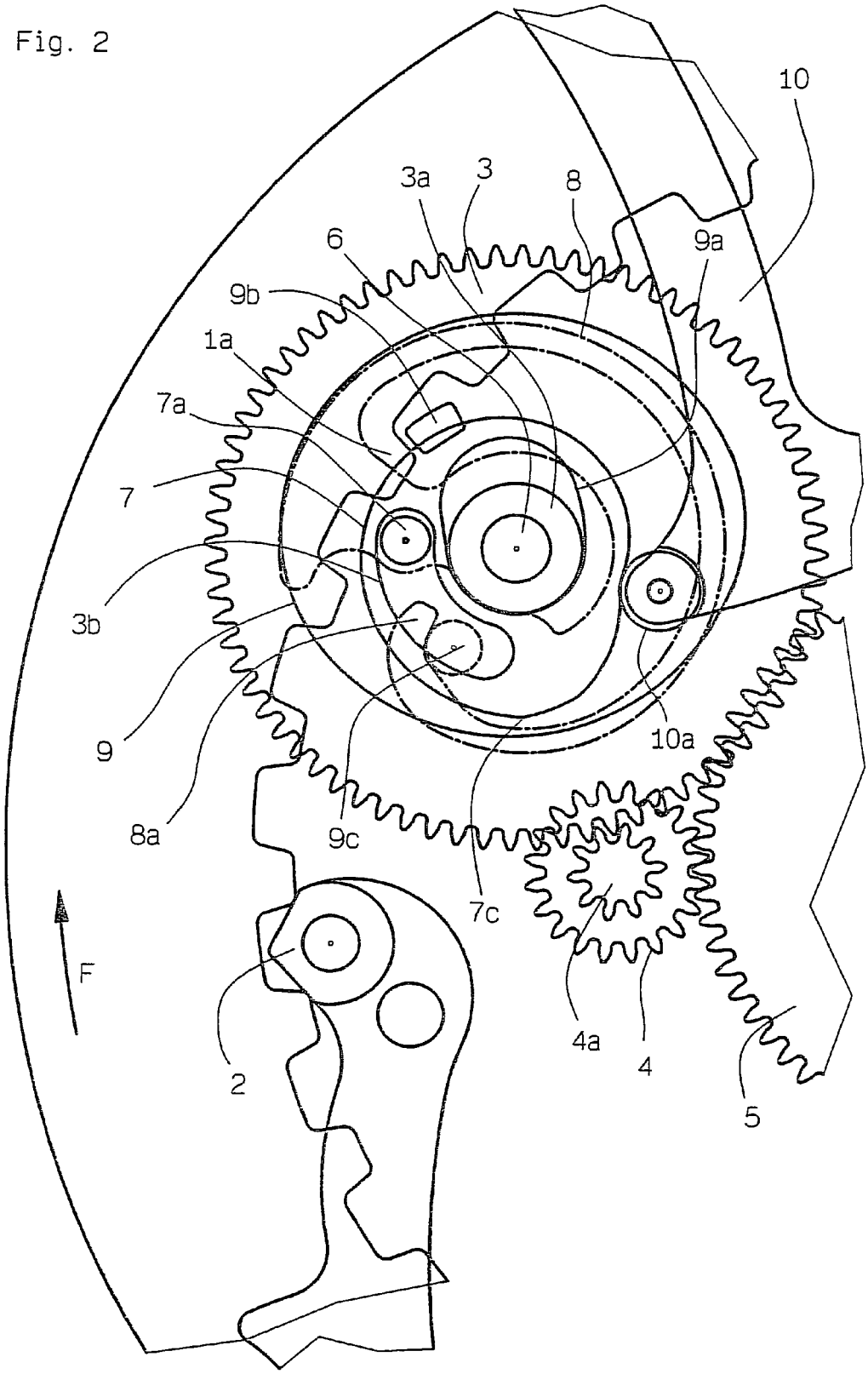
FIG. 2 is an enlarged partial view of FIG. 1, showing the date mechanism just after the instantaneous jump.
Figure 3:
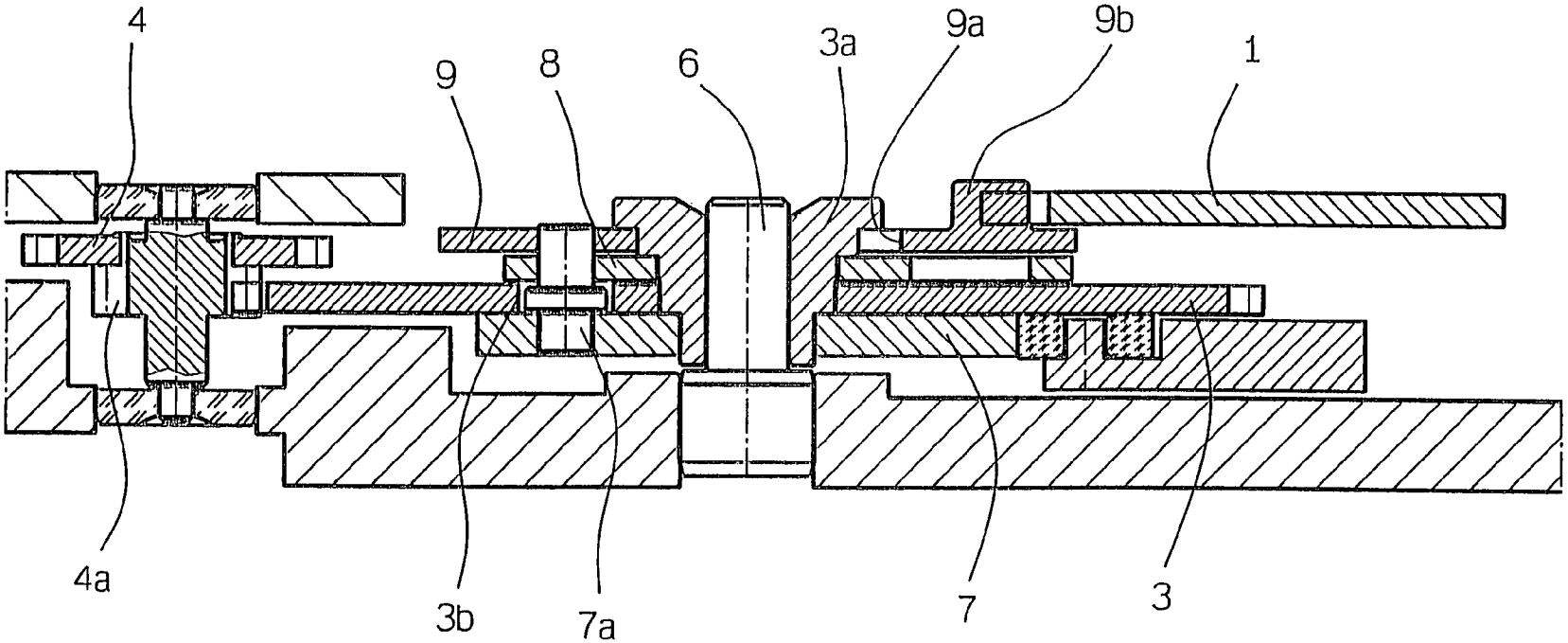
FIG. 3 is a sectional view along the line III—III of FIG. 1.
Figure 4:
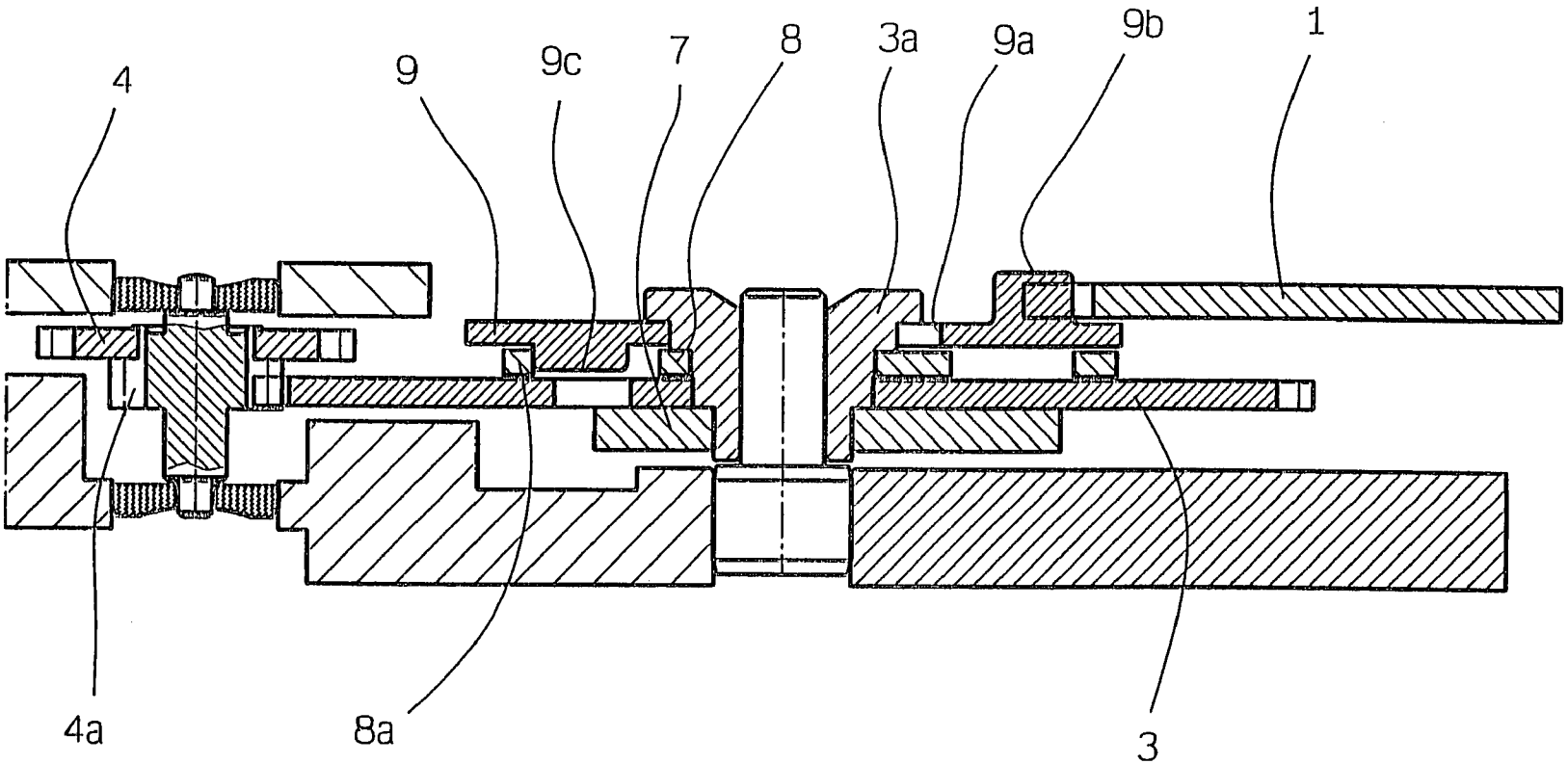
FIG. 4 is a sectional view along the line IV—IV of FIG. 1.

The driving wheel 3 is fixedly connected to a hub 3*a* mounted pivotably on an axis 6. This hub 3*a* bears an instantaneous-jump cam 7, in which an eccentric pin 7*a* is press-fitted (FIGS. 2 and 3). This eccentric pin 7*a* passes through an opening 3*b* in the shape of an annular sector, centered on the axis of the driving wheel 3. This eccentric pin 7*a* further passes through one end of a return spring 8, through which the hub 3*a* of the driving wheel 3 also passes, so that this end of the return spring 8 is held fixedly between these two securing elements 3*a* and 7*a*. Finally, the eccentric pin 7*a* passes through a plate-shaped release member 9, additionally provided with an elongated opening 9*a* delimited at its ends by two arcs of circles of identical radius mutually linked by two arcs of concentric circles whose radii differ from the value of the diameters of the two circular arcs delimiting the ends of the opening 9*a*. The foot of the perpendicular dropped from the axis of the eccentric pin 7*a* onto the straight line joining the centers of the two circular arcs delimiting the ends of the elongated opening 9*a* is situated midway between the centers of these two circular arcs (FIG. 2).

By virtue of this arrangement, the release member 9 is able to rotate about the axis of the eccentric pin 7*a* through an amplitude corresponding to the distance separating the centers of the two circular arcs delimiting the ends of the elongated opening 9*a*.

Figure 5:
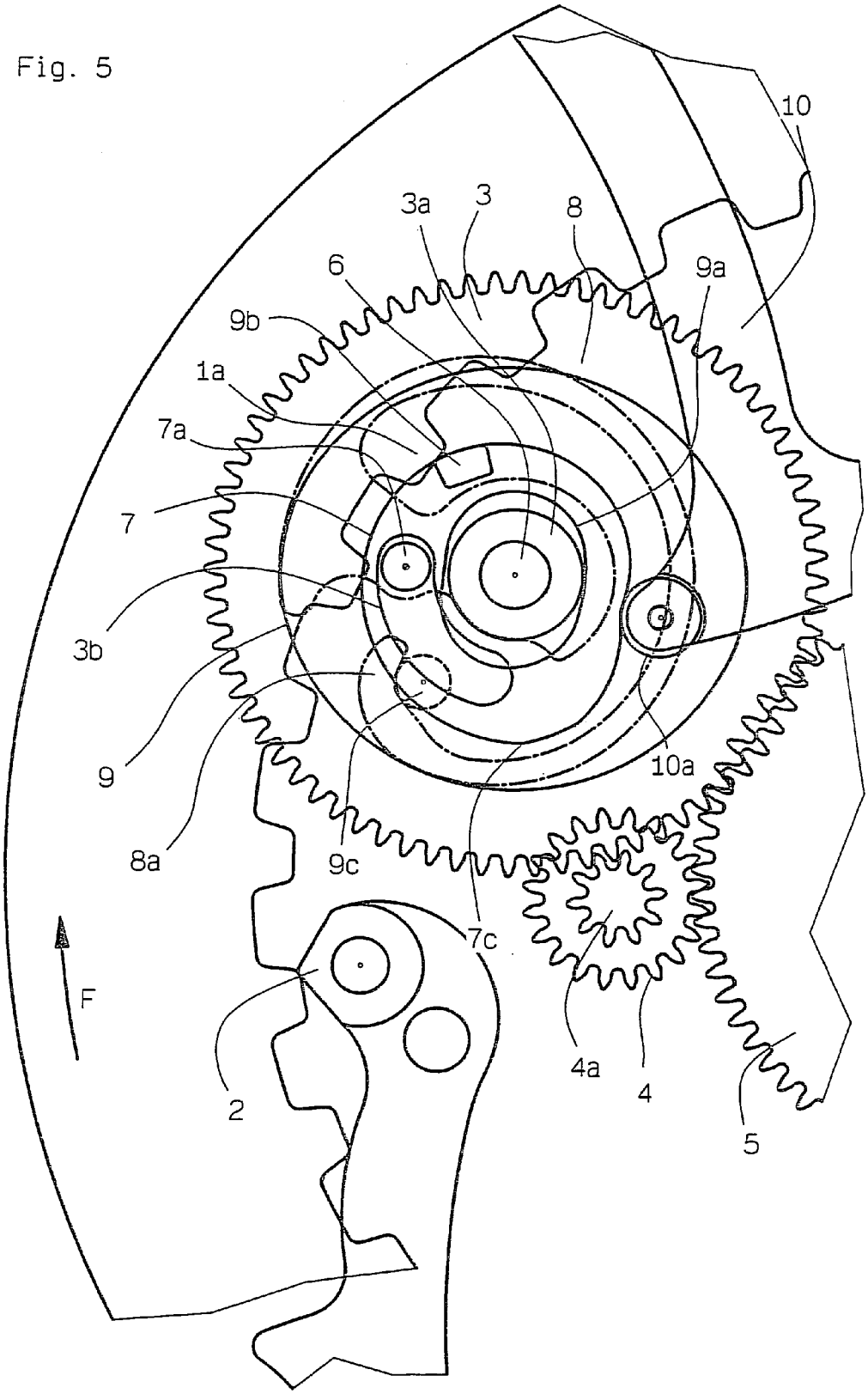
FIG. 5 is a view similar to FIG. 2 in another position of the mechanism.

This release member 9 bears on one face a driving finger 9*b* intended to enter into engagement with the toothing 1*a* of the calendar ring 1. On the other face, this release member 9 bears a circular projection 9*c*, onto which a curved end 8*a* of the return spring 8 is hooked, subjecting this return spring 8 to a fixed preload. By virtue of this arrangement, the driving finger 9*b* behaves like a rigid finger while the calendar mobile 1 is driven, given that the elongated opening 9*a* of the release member 9 is held abutted against the hub 3*a* of the driving mobile 3. By contrast, when this finger 9*b* is in the position illustrated by FIG. 2 and the calendar mobile 1 is driven in the direction of the arrow F by the manual date-resetting mechanism (not represented), the release member 9 is able to pivot about the eccentric pin 7*a*, counter to the force of the spring 8, into the position illustrated in FIG. 5, allowing the driving finger 9*b* to move to make room for the tooth of the toothing 1*a* of the calendar mobile 1.

The date mechanism further comprises an energy accumulator for the instantaneous jump of the calendar mobile. This energy accumulator (FIG. 1) comprises a lever 10 provided with a roller 10*a* pressed against the edge of the cam 7 by an instantaneous-jump spring 11. FIG. 1 illustrates this instantaneous-jump date mechanism just before the instantaneous jump, at the moment when the maximum energy is accumulated in the instantaneous-jump spring 11 through tilting of the lever 10 in the anti-clockwise direction. This position corresponds to midnight. As soon as the cam 7 is driven by the edge of the annular-sector-shape opening 3*b* in the driving wheel 3 from the position illustrated by FIG. 1, the roller 10*a* passes the tip of the cam 7, whereby the energy of the instantaneous-jump spring 11 can be released, abruptly rotating the cam 7, the release member 9 with its driving finger 9*b* and the return spring 8 into the position illustrated by FIG. 2, in which the unloading of the instantaneous-jump spring 11 is arrested by a slightly concave portion 7*b* of the cam 7, allowing the calendar mobile 1 to be advanced by one step in cooperation with the spring-action positioning jumper 2. The detention of the cam 7 in the position illustrated by FIG. 2 by its concave portion 7*b* corresponds to the holding of the driving finger 9*b* between two teeth 1*a* of the calendar mobile 1, preventing the latter from moving by more than one step, consecutively to the impetus imparted upon it by the release of the instantaneous-jump spring 11, in which the energy necessary for the instantaneous jump has been stored between the concave part 7*b* of the cam 7 and its tip 7*c*, corresponding to its part of greatest radius.

The displacement of this unit formed by the cam 7, the release member 9 and the return spring 8, mutually linked by the pin 7*a*, is possible by virtue of the annular-sector-shaped opening 3*b* made through the driving mobile 3.

As has been discovered in the course of the preceding description, when the calendar mobile 1 is being driven, the driving finger 9*b* behaves like a rigid finger owing to the fact that the elongated opening 9*a* in the release member 9 is held by the return spring 8 against a stop formed by the hub 3*a* of the driving mobile 3, the pivot axis of which is coaxial with that of the driving finger 9*b*. The trajectory of this driving finger 9*b* is therefore perfectly defined, in which case the driving finger behaves, therefore, like a fixed finger.

By contrast, when a tooth 1*a* of the calendar mobile exerts an oppositely directed torque upon the driving finger 9*b*, the latter pivots about the second eccentric pivot axis 7*a*, counter to the force of the return spring 8. The driving finger 9*b* then behaves like an elastic finger. The two modes of behavior of the driving finger 9*b* therefore have no influence one upon the other.

Since the spring 8 is preloaded, it is possible to precisely define the torque necessary to hold the opening 9*a* of the release member 9 abutted against the hub 3*a* with a view to allowing the detention of the calendar mobile 1 after the instantaneous jump, yet allowing the release of the driving finger 9*b* through pivoting of the release member 9 about the eccentric pin 7*a*, when the calendar mobile is manually actuated by the date-resetting device.

What is claimed is:

1. A timepiece with date, mechanism, comprising a calendar mobile (1) with a tooting engaging with an angular positioning jumper (2), a mobile (3) with a hub for driving this calendar mobile (1), a positive connection (4, 5) between this driving mobile (3) and a minute train for rotating said driving mobile (3) at the rate of one turn every twenty-four hours, an instantaneous-jump cam (7), an elastic energy accumulator (10, 11) engaging with this cam (7) in order to displace it instantaneously once per turn of said driving mobile (3), a finger (9*b*) kinematically connected to this cam (7) in order to drive the calendar mobile (1), a kinematic connection (3*b*, 7*a*) between the driving mobile (3) and the cam (7), with a degree of freedom chosen to allow said elastic energy accumulator (10, 11) to release its energy by imparting upon it a relative movement, to enable the driving finger (9*b*) to displace the calendar mobile (1) instantaneously by one step, wherein the driving finger (9*b*) is borne by a release member (9) which is mounted pivotably about two axes, the first of which is that of the hub (3*a*) of said driving mobile (3) and the second of which is that of a pin (7*a*) fixedly connected to this driving mobile (3), this release member (9) having an opening (9*a*) configured to allow an angular displacement about the second of these two axes, whereby the driving finger (9*b*) can be released from the toothing (1*a*) of the calendar mobile while the calendar is corrected, and a preloaded return spring (8) which tends constantly to rotate said driving finger (9*b*) about said second pivot axis in order to bring an edge of said opening (9*a*) to butt against said hub (3*a*), a position in which said driving finger is engaged with the toothing of said calendar ring (1).

2. The timepiece as claimed in claim 1, in which the respective ends of said preloaded spring (8) are fixedly connected to an anchoring element (9*c*) of said release member (9) bearing the driving finger (9*b*) and with the two pivot axes (3*a*, 7*a*) of this same member, said spring being held under pretension between its two ends.

* * * * *